US005423951A

United States Patent [19]

Wienert

[11] Patent Number: 5,423,951

[45] Date of Patent: Jun. 13, 1995

[54] PROCESS OF CONTINUOUSLY MAKING COKE OF HIGH DENSITY AND STRENGTH

[76] Inventor: Fritz O. Wienert, 394 Roosevelt Ave., Niagara Falls, N.Y. 14305

[21] Appl. No.: 808,662

[22] Filed: Dec. 17, 1991

[51] Int. Cl.[6] ..... C10B 49/06

[52] U.S. Cl. ..... 201/6; 201/9; 201/20; 201/22; 201/24; 201/32; 201/44

[58] Field of Search ..... 201/6, 8, 9, 22, 21, 201/24, 20, 32, 42, 44; 202/99, 117

[56] References Cited

U.S. PATENT DOCUMENTS

| | | | |
|---|---|---|---|
| 3,167,487 | 1/1965 | Mansfield | 201/29 |
| 3,444,046 | 5/1969 | Harlow | 201/6 |
| 3,470,275 | 9/1969 | Ban | 201/29 |
| 3,966,561 | 6/1976 | Hinkley | 201/6 |
| 4,022,668 | 5/1977 | Palumbo et al. | 201/44 |
| 4,111,755 | 9/1978 | Ban et al. | 201/6 |
| 4,141,793 | 2/1979 | Aoki et al. | 201/6 |
| 4,419,186 | 12/1983 | Wienert | 201/6 |

*Primary Examiner*—Joye L. Woodard
*Attorney, Agent, or Firm*—Wallace F. Neyerlin

[57] ABSTRACT

Pieces of coke of high density and strength are made continuously from fine particles of bituminous or subbituminous or lignite coals or of mixtures thereof. The particles are generally oxygenated, mixed with water, compressed to squeeze out some of the water to obtain single bodies which are heat processed lying on a traveling grate on which they undergo drying, pyrolyzing, carbonizing and cooling.

Modifications include mixing in with the coal material(s) listed above, coke fines or char or anthracite coal; or limestone; or carbon-reducible oxides such as oxidic ores of Fe, Mn, Cr and quartzite in recited important proportions. Such formed coke bodies are useable in a submerged arc furnace or in a blast furnace or in an open hearth to produce desired intermediate or end metallic products. The pieces of coke with incorporated fine limestone burn without developing $SO_2$.

10 Claims, 1 Drawing Sheet

PROCESS OF CONTINUOUSLY MAKING COKE OF HIGH DENSITY AND STRENGTH

BACKGROUND OF THE INVENTION

Figure 1:
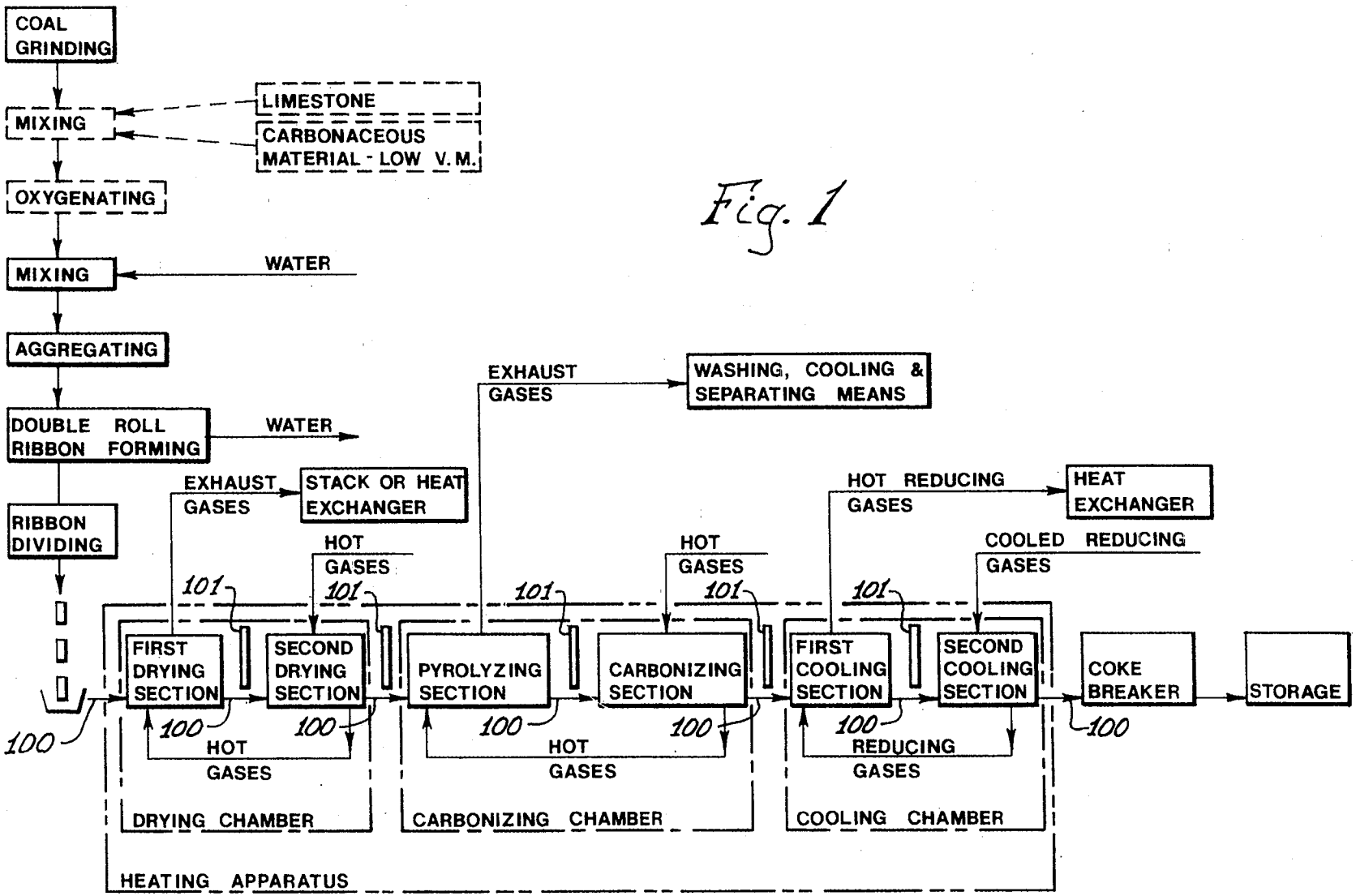

The present invention utilizes a part of the technology described in the U.S. Pat. Nos. 4,419,186 and 4,613,363 both invented by the present inventor. The steps applied in the present invention relate to the compaction of fine particles and comprise mixing the fine particles with sufficient water, pressing and stirring the mixture several times to form aggregates and then compacting the aggregates under a momentary pressure in the range from about 800 to 1600 kg per sq cm whereby some of the added water is squeezed out, to a continuous ribbon about 5 cm thick. Such pressure is achieved by means of smooth double rolls. The obtained ribbon is divided into compacted moist single bodies.

DESCRIPTION OF RELATED ART

In the prior art of making metallurgical coke, a slot coke oven has been widely used in which a charge of selected bituminous coals is batchwise heated to about 1100° C.

SUMMARY OF THE INVENTION

Coke of high density and strength is made continuously from fine particles of bituminous of subbituminous or lignite coals or mixtures thereof by oxygenating the selected fine particles, that is, combining them with oxygen by contact with air at temperatures under about 220° C. to a certain extent, moistening the properly oxygenated particles, pressing them by double rolls to moist compacts, drying, pyrolyzing, carbonizing the compacts up to at least 650° C. to about 750° C., cooling the shrunken coke while lying on a traveling grate, and discharging the coke bodies from the grate into a breaker. For dividing them into pieces of the desired size. The obtained pieces are a hard smokeless fuel and can be used advantageously in a blast furnace for making iron.

A modification of the above process comprises mixing fine particles of carbonaceous material low in volatile matter such as anthracite coal, coke fines or char with the fine coal particles in which the extent of the oxygenating has been decreased in proportion to the increasing amounts of the particles low in volatile matter down to no more oxygenation. In such a case the shrinking to hard coke of high density occurs anyhow.

Another modification comprises the incorporation of fine particles of calcium carbonate in the moist compacts of the fine coal particles containing sulfur. The proportion of the incorporated calcium carbonate amounts to an excess of about 10% over the stoichiometric amount of sulfur in the hard coke pieces made on the traveling grate. This amount of calcium carbonate also decreases the optimal extent of the oxygenation determined empirically. In the laboratory the resulting shrunken hard pieces of coke containing fine limestone burned without noticeable pollution, as the sulfur dioxide was trapped in the form of calcium sulfate.

Another modification comprises making, from the discharge on the traveling grate, hard pieces of coke composites containing fine particle of carbon-reducible oxides. Such composites are self-reducing, when they are heated in a submerged arc furnace, as quasi-solid state reactions lead to the reduction of the oxides before any fusion occurs. Subsequent melting produces iron or ferro-alloys or silicon respectively. The power consumption is considerably lower than in the prior art of feeding pieces of the oxides and of the reducing carbon. Furthermore the top gases of the arc furnace are clean enough to be utilized.

In another modification, the hard self reducing pieces of the composites of coke-oxides are fed into a low-shaft blase furnace fired by the partial combustion of coal dust and/or fluid fuel. The resulting melts are the same as those tapped from the submerged arc furnace. The hot iron may be converted to a high grade of carbon steel free of any harmful contaminants in an oxygen converter. Liquid ferro-chrome with about 20% Cr is converted in an oxygen converter to 18-8 stainless steel.

Still another modification comprises charging the hard self-reducing composites of coke, FeO or of coke, $FeO\text{-}Cr_2O_3$ into an open hearth, heating the charge to obtain a metal pool by a flame from injected fuel oil into the hot ash from the checkers; and by the combustion of CO to $CO_2$ and by injecting oxygen into the metal pool until the desired carbon content in the steel is obtained, or until all the carbon is removed from the stainless steel.

In other words the open hearth makes it possible to produce carbon steel or stainless steel directly although in a less economical way than via the low shaft blast furnace and oxygen converter.

The process of the invention and various modifications and features thereof are as illustrated in FIG. 1. In this Figure, numeral 100 represents a traveling grate which goes through a compartmentalized heating apparatus comprising a drying chamber, a carbonizing chamber, which consists of a first pyrolyzing section and a second carbonizing section, and a cooling chamber. Numeral 101 depicts separating aprons, variously located in the compartmentalized heating apparatus. Labeled boxes with dotted lines denote process alternatives.

For east of description the present invention is separated into 4 parts which follow:

PART 1

MAKING CONTINUOUSLY COKE OF HIGH DENSITY AND STRENGTH BRIEF DESCRIPTION OF THE PART 1 PROCESS OF THE PRESENT INVENTION

The starting material of the present process are any type of bituminous, subbituminous or lignite colas or mixtures thereof, provided the ash and sulfur contents are tolerable so that a most favorable source of carbon can be selected.

Making the various coals and mixtures thereof suitable for the present process is based on the discovery that the selected coal or mixtures thereof must be divided into particles smaller than about 0.2 mm and then treated with air at temperature below about 220° C. to oxygenate them, that is, to combine them with oxygen by an exothermic reaction to a predetermined optimal extent as defined later.

It was found that such optimal extent of oxygenation causes a small amount of a transient liquid phase to form in the compacts made according to the present process when the compacts pass through the temperature range of 350° to 475° C. and that the compacts begin to shrink and that shrinking continues with rising temperatures and that the rate of shrinking increases when the temperature rises slower. Such favorable heating rate is realized by the use of an endless traveling grate which also serves for drying the moist compacted bodies and finally for cooling the produced coke of high density and strength.

The traveling grate goes through a heating apparatus or system comprising a drying chamber, a pyrolyzing section, a carbonizing section and a cooling section. These chamber(s) and/or sections may be subdivided as hereinafter indicated.

The procedure is as follows: the moist compacted bodies are placed on the traveling grate to form a bed at least 30 cm deep. The bed moves with the grate under a horizontal bar hanging horizontally by means of chains from a stationary support so that the bar equalizes the depth of the bed. Then the moving bed enters the drying chamber, passing under an apron made of flexible material and hanging down from the ceiling of the drying chamber to let its edge slide on the surface of the bed, thus preventing the escape of gases from the drying chamber. After grate and bed have traveled about 5 minutes there is another apron dividing the first from the second section (section 2) of the drying chamber. Under each section there is a bin receiving the gases coming down through the bed or directing the gases to flow upwards through the bed.

For drying the bed, combustion gases of a fluid fuel coming from an oven are introduced above the bed in the first section and are drawn through the bed into the bin and from there into a duct leading to a centrifugal fan blower which blows the bases into the bin under Section 2 by flowing upwards through the bed and finally to the exhaust of the section 2 leading to a stack or to a heat exchanger. Bed and grate move through the second section where it is oxygenated in about 3 minutes whereby the bed must not be heated to higher than about 220° C. (A higher temperature would cause pollution and would also adversely affect the effect of the oxygenation.). Then the bed on the grate and grate pass another apron and enter the pyrolysis (first) section of the carbonization chamber in which the bed is heated to about 500° C. for the pyrolysis in at least about 30 minutes by the gases from the second section of the carbonization chamber blown upwards through the bed and exhausted into a washer-cooler, as is applied in connection with a slot coke over, so that hydrogen sulfide is removed and the condensed volatile matter is separated from the clean area.

Grate and bed leaving the pyrolysis section pass another apron and enter the carbonization section of the carbonizing chamber in which the bed is heated in at least 30 minutes from about 500° to between 700° and 750° C. by the gases of the combustion of a fluid fuel in a separate over. These gases are introduced into the section above the bed at the end of the section and are drawn through the bed downwards into the bin and from there into a centrifugal blower which blows them into the bin of the first section and moves the gases upwards through the bed as described above.

After 30 minutes in the carbonization section, the shrunken coke bodies on the grate pass under an apron and enter the cooling chamber which is filled with a reducing gas and is divided into two sections. The reducing gas being colder than 200° C. is moved from a heat exchanger to flow downwards through the bed of the coke bodies in the second section and upwards through the bed of the first section and then to the heat exchanger and finally back to the second section. The coke bed colder than about 200° C. leaves the cooling chamber under an apron and is discharged from the grate into a breaker to obtain the desired sizes.

It is to be noted than the present process does not involve any inherent pollution.

More specific aspects of the various parts of the present invention are provided by the Examples which follow.

EXAMPLES

The optimal extent of the oxygenation of Part 1 process must be determined empirically; However, doing this on the scale of production involving a traveling grate would be cumbersome and costly. Therefore, it was carried out in the laboratory by simulating the events on the traveling grate by preparing compressed moist cylinders one at a time each with a different extent of oxygenation, exposing the moist cylinder lying in rest to the heating rates and the compositions of the surrounding gas as during the same time periods referred to above as each compressed body would encounter them on its way within the traveling grate heating system.

EXAMPLE 1

This example illustrates the procedure of the test but does not include any oxygenation, in order to show the effect of omitting the oxygenation. Accordingly the procedure was as follows: 4.0 g of widely available sub-bituminous coal containing in this case 55% fixed carbon and 35% volatile matter were finely divided into particles smaller than about 0.2 mm. The "dividing" of the coal was carried out by impact grinding so as to avoid grinding the particles too fine. More than 5% "superfines" (i.e. fines smaller than 5 microns) is undesirable. These particles were mixed with 0.6 g of water and the mixture was pressed and stirred several times (called mulling) to aggregates which were compacted in a steel cylinder having a bore of 12 mm by a piston under a momentary maximum pressure of 1300 kg per sq. cm. A small amount of water use squeezed out. The resulting moist cylinder weighed 4.5 g and was 26.6 mm long and had a diameter of 12 mm.

The simulation of the heating on the traveling grate was as follows: the moist cylinder was put into a boat which was inserted into a silica tube. The tube had been previously heated to about 220° C. by electric resistance wires surrounding the tube. A gentle flow of the gases from a complete combustion of a fluid fuel has also been maintained through the tube. Ten minutes after the inserted of the cylinder, corresponding to the passage time of the bed through the drying chamber, the combustion gases were replaced by a reducing gas and the temperature was increased to about 350° C. in about 10 minutes. The further rising temperature reached about 475° C. in about 20 minutes and the final maximum 650° C. was reached after another 20 minutes. Then the tube and its content were quickly cooled after turning off the power by opening the lid of the furnace. When the carbonized body was colder than about 200° C., the reducing gas was turned off and the carbonized body was taken out of the tube. It had swollen to a non-symmetrical shape and weighed 2.88 g. Its apparent density was 0.55 and its strength was not measurable. Evidently the lack of any oxygenation was responsible for the swelling.

EXAMPLE 2

DRYING AND OXYGENATING MOIST COMPACTS BEFORE CARBONISATION

In this example a moist cylindrical compact was prepared exactly as in Example 1. It weighed 4.55 g and was 26.7 mm long. It was also placed in a boat which was inserted into the same silica tube which was preheated electrically to about 220° C. as in Example 1, but a gentle flow of air was maintained during the drying. The electric heat was throttled to prevent the exothermic heat of the oxygenation from raising the temperature over about 220° C. 25 minutes after the insertion of the moist cylinder into the tube, the now dehydrated and oxygenated cylinder was taken out into the open air. It weighed 3.91 g and was 26.7 mm long. It was put back into the silica tube through which now a gentle flow of a reducing gas was conducted as in Example 1 while the heating to higher than 220° C., was carried out in the same manner as in Example 1, and so was the cooling procedure. The obtained coked cylinder weighed 2.85 grams. Its length had shrunken from 26.7 mm to 19.45 mm. The diameter had shrunken from 12 to 10.45 mm. The apparent density was 1.445 and cut faces of the cylinder showed no pores. The strength was estimated to be much higher than that of high quality slot over coke. This Example 2 proves that the oxygenation is responsible for the high density. However, it would not be practical to oxygenate the compacts on the traveling grate for a long period of time as it would decrease its production capacity.

EXAMPLE 3

OXYGENATION OF THE LOOSE FINE COAL PARTICLES

This example is a simulation of the preferred procedure involving the oxygenation of the same particles as used in the Examples 1 and 2. Accordingly 4.0 g of said coal particles were spread in a thin layer on a watch glass which was placed into an oven filled with air and preheated to about 180° C. After 10 minutes, the oxygenated particles were taken out of the oven and cooled to room temperature. They weighed 3.96 g. The loss of 0.04 g was composed of the loss of residual water from the coal and the gain in weight by the combination with oxygen. The oxygenated fine coal particles were then mixed with water, densified to crumblike aggregates by mulling and compacted to a moist cylinder as in Example 1. It weighed 4.41 g, and its length was 27.4 mm. This moist cylinder was then heat treated in a reducing atmosphere as in Example 1 up to about 650° C. The cooled cylinder weighed 2.89 g; its length had shrunken to 26.0 mm. The apparent density was 1.19. The strength was high. Cut faces of the cylinder showed that it had small pores in uniform distribution but surrounded by a solid matrix which explains the relatively high strength. As the apparent density was lower than in Example 2 the question was whether the period of oxygenation had been too short or too long. Assuming it was too short, it was prolonged in the following example.

EXAMPLE 4

OXYGENATING FINE COAL PARTICLES OVER A PERIOD OF 15 MINUTES

This Example 4 is a repeat of Example 3 except that the 4.0 g of the fine coal particles were taken out of the oxygenating oven 15 minutes after they had been placed into it. Otherwise, the procedure of making the moist compressed cylinder and the heat-treatment were the same as in Example 3. The final carbonized cylinder had the apparent density of 1.08 which is lower than in Example 3. The above assumption was wrong. Rather, the fine coal particles should be oxygenated over a shorter period than 10 minutes, for instance, over only 8 minutes. Optimal oxygenation is than amount which results in coke pieces with the highest shrinkage and strength; and which also makes possible the processing of all of the coals named herein according to the procedures of the present invention. If there is too little or too much oxygenation, the density and strength of the coke pieces are reduced. It must be understood that suitable equipment must be installed for the oxygenation on a commercial scale.

EXAMPLE 5

CARBONACEOUS PARTICLES LOW IN VOLATILE MATTER INCORPORATED IN HARD COKE

It was found that fine particles of carbonaceous matter low in volatile matter such as anthracite coal, coke breeze, coke fines and char, mixed with the coal fines of the present process decreases the extent of the optimal oxygenation, the more so the greater the proportion of the low volatile particles is; such that no oxygenation has to be carried out anymore when a certain proportion of the low volatile particles is reached. This proportion depends on several factors, for instance, on the characteristics of the coal particles and of the low-volatile material. Thus the lack of oxygenation does not prevent a high density of the resulting coke if said proportion of low volatile particles is reached or exceeded. This is illustrated in the following Example 5 (in which the use of a traveling grate was simulated) by mixing 2.0 g of particles smaller than 0.2 mm of the same subbituminous coal as in Example 1 with 2.0 g of particles smaller than 0.4 mm of a coke breeze with 88% fixed carbon. The low volatile particles should favorably be divided into sizes smaller than about 0.4 mm rather than smaller than 0.2 mm in order to decrease the total surface area of the particles employed in making the formed coke. (No oxygenation was carried out.) The mixture was mixed with sufficient water and mulled to densify it to aggregates which were compressed under a momentary maximum pressure of 1300 kg per sq. cm to a moist cylinder as in Example 1. The moist cylinder weighed 4.5 g and was 25.5 mm long. As in Example 1 the moist cylinder was dried, pyrolyzed, carbonized up to 650° C. and cooled in simulation of the traveling grate. The obtained coke cylinder weighed 3.15 g and had shrunk to 24 mm. Its strength was satisfactory.

Another identical moist cylinder was heat-treated as in Example 5 except that the period of carbonisation was prolonged by 10 minutes and the maximum temperature was increased to 750° C. The strength of the obtained coke cylinder was considerably higher.

HIGH DENSITY COKE WITH INCORPORATED FINE CALCIUM CARBONATE FOR TRAPPING SULFUR OXIDES AS CALCIUM SULFATE WHEN SAID COKE IS BURNT

BACKGROUND

It was reported in Chemical Engineering, Jul. 22, 1974 that pellets of sulfur-containing coals and fine calcium carbonate trapped 95% of the sulfur as calcium sulfate when they were burnt in air provided a considerable excess of calcium carbonate had been applied. However, the pellets were soft and disintegrated to a powder when they were handled and especially when they were heated during burning. The instability has prevented any practical application of such pellets.

DESCRIPTION OF THE PRESENT PROCESS

In contrast, the high-density coke pieces with incorporated fine particles of limestone according to the present process are hard and remain hard while they burn. The formed calcium sulfate is intermingled with the ash and goes with it for the disposal.

As most coals contain from 20 to 35% of the total sulfur content in the form of pyrite and as this sulfur escapes as hydrogen sulfide during the carbonization, the amount of the fine limestone, which has to be mixed with the fine coal particles for the subsequent compaction, is stoichiometrically related to the amount of sulfur in the high-density coke pieces as shown in the following example.

EXAMPLE 6

In this example the same subbituminous coal as in Example 1 was applied. 100 g of this coal contained 2.5 g sulfur of which 0.75 g are pyritic and escape during the carbonization, so that 1.75 g of sulfur remain in the final high-density coke made from 100 g of coal.

In order to make one high-density carbonized cylinder and to predetermine the shrinkage resulting from a certain degree of oxygenation an amount of 4 g of said subbituminous coal in the form of fine particles was applied. The resulting high density coke cylinder contained 0.07 g of sulfur which requires 0.22 g of fine calcium carbonate as limestone with 95% CaCO3 according to the relation $S+air+CaCO_3 \rightarrow CaSO_4$. Adding an excess of 10%, a total of 0.28 g of the fine limestone particles was mixed with said 4 g of the coal particles. The mixture was oxygenated as in Example 3, but only for 5 minutes as the limestone particles decrease the extent of the oxygenation required to reach optimal.

The oxygenated particles weighed 4.21 g including the 0.26 g of the fine limestone particles. This mixture was mixed with sufficient water as in Example 3 and compacted to a moist cylinder weighing 4.67 g and having a length of 28.7 mm. This moist compact was heat-treated as in Example 3 simulating the conditions of the traveling grate. The cooled carbonized cylinder weighed 3.18 g and was 25.4 mm long. The apparent density was 1.32 and the strength was satisfactory.

Pieces of the coked cylinder were placed into a small crucible standing on a hot plate and were burnt in air. The smell of sulfur dioxide could not be noticed. Ash and calcium sulfate settled on the bottom.

If the laboratory procedure is scaled up to an industrial scale, several advantages will occur apart from the almost pollution-free combustion: the disposal of the ash intermingled with calcium sulfate will be simpler than that of the wet mixture of fly ash and calcium sulfite coming from the widely used scrubbing technology. It may even be possible to utilize the dry mixture of ash and calcium sulfate for building blocks, and road foundations. The absence of fly ash in the boiler gases makes it possible to clean the boiler gases in a settling chamber sufficiently without an electric precipitatior.

The known processes of upgrading fine coal particles by lowering the contents of minerals including pyrites produce fine coal particles to be used as fuel. The present process will convert the fine coal to a high-density coke which can be burnt without pollution so that a higher market value can be realized.

Part 2

MAKING HARD COMPOSITES OF COKE—CARBON-REDUCIBLE OXIDES FOR SMELTING TO IRON, FERROALLOYS AND SILICON IN A SUBMERGED ARC FURNACE

BACKGROUND

The U.S. Pat. No. 4,613,363 of the present inventor described the making of moist compacted bodies as the precursor of self-reducing coke composites with carbon-reducible oxides. These moist bodies were immediately fed into a submerged arc furnace in which they were dried and carbonized before melting. This prior art has a number of drawbacks, for instance, water and volatile matter condensed in the colder parts of the burden and tended to cause hanging and the formation of bridges which lead to an irregular descent of the burden into the smelting zone and thus to fluctuations of the compositions of the tapped products, and to a higher power consumption. Furthermore the top gases of the furnace were a mixture of carbon monoxide, volatile matter of the coal, smoke and fumes so that it is difficult and often not profitable to recover the carbon monoxide. All the drawbacks are overcome by the present invention.

BRIEF DESCRIPTION OF MAKING HARD SELF-REDUCING COMPOSITES OF COKE-CARBON-REDUCIBLE OXIDES FOR SMELTING IN A SUBMERGED ARC FURNACE

In this process the moist compacted bodies made according to the present invention are hot fed into the submerged arc furnace but are placed onto a traveling grate to form a bed which is at least 30 cm deep as for making high density coke. The same heat treatment and cooling as for coke are also applied to the moist composites so that coke carbon-reducible oxide composites are obtained.

As in the case of making high density coke, the conditions for obtaining hard coke composites were investigated by simulating the events on the traveling grate as described before in reference to making coke.

It was found that the oxygenation of the coal particles must be omitted because of the high proportion of the oxide particles. It was also found that particles of the oxide materials and of the slag forming additives smaller than 0.4 mm improve the strength of the final coke composites and that superfine, that is, sizes smaller than about 5 microns should be absent when the moist compressed bodies are made. The moist compacted composites are not charged into a submerged arc furnace as in the prior art of the present inventor but they are placed on a traveling grate and treated on it as described above in reference to coke of high density. The obtained pieces of hard self-reducing composites of coke and carbon-reducible oxides are then charged into a submerged arc furnace and smelted to iron, ferroalloys or silicon respectively.

Specific data are reported in the following examples.

EXAMPLE 7

MAKING SELF-REDUCING COKE-FeO COMPOSITES FOR SMELTING TO IRON IN A SUBMERGED ARC FURNACE

In order to facilitate the comparison with prior art and related processes, the starting materials for this Example 7 are calculated in reference to 1000 kg of liquid iron with 95% Fe, 2% Si and 3% C. Then the 950 kg of Fe require 1746 kg of an iron ore with 57% Fe. Assuming that the losses in the process are balanced by the Fe content in the applied coal, the 950 kg of Fe are obtained by the reduction of 1249 kg of FeO by 204 kg of C. The 20 kg of Si require 17 kg of C and the carburisation of the liquid iron requires 30 kg of C. Altogether 251 kg of C must be contained in the pieces of the self-reducing coke composites as made by the application of the traveling grate process of the present invention and are introduced at the start of this example in the form of particles smaller than nominal about 0.2 mm of a subbituminous coal containing 55% fixed carbon and 35% volatile matter. However, it was found that the pyrolysis of the coal particles within the compacts over a prolonged period of time forms about 3% additional carbon so that said coal introduces 58% effective carbon and the above 251 kg of C are brought in by 433 kg of said subbituminous coal. Furthermore, 250 kg of limestone in particles smaller than nominal about 0.4 mm are required. In summary the starting materials for 1000 kg of liquid iron are: 1746 kg of fine iron ore with 57% Fe, 433 kg of fine subbituminous coal with 58% effective carbon and 250 kg of fine limestone. On the credit side are the major parts of the condensed volatile matter and of the cleaned off-gas from the traveling grate and the top gas from the arc furnace. The power consumption is estimated to amount to 1400 kwh. It must be noted that the produced iron is free of tramp elements which are contained in ordinary scrap.

For the simulation of the heat-treatment on the traveling grate, a single moist compact was made, as in previous examples, from 1/250,000 fractions of each of the above starting materials. Accordingly 1.73 g of said subbituminous coal in particles smaller than 0.2 mm (without any oxygenation), 6.98 g of said iron ore with 57% Fe in particles smaller than 0.4 mm and 1 g of limestone in particles smaller than 0.4 mm were mixed. The mixture weighing 9.71 g was mixed with sufficient water, mulled to densified aggregates which were compressed under a momentary maximum pressure of 1300 kg per sq. cm to a moist cylinder weighing 10.78 g. It was placed into the silica tube used before for the simulation of the traveling grate. Therein it was dried, pyrolyzed and carbonized up to 700° C. as described in Example 1. Then the obtained self-reducing coke composite was not cooled for the transfer to the submerged arc furnace but was left in the silica tube and heated further in 40 minutes to about 1000° C. thus imitating the rise of temperature when the cylinder descends somewhat deeper in the arc furnace. Then the heating was terminated and the cylinder was cooled in the reducing atmosphere to below 100° C.

It was found that the part of the cylinder which had been touched by the piston during the compression was swollen and that the degree of swelling decreased gradually with the distance from the face previously touched by the piston so that the swelling changed to shrinking in a distance of about 20 mm. The remaining length of the cylinder had shrunk to a considerable degree. Both parts of the cylinder were completely metallized. As it is known that certain iron ores and pellets of iron oxides swell when they are reduced by hydrogen it is assumed that this was also the case in this example. The hydrogen is apparently the residual quantity released from the coke at the higher temperature. The higher momentary pressure near the piston is apparently the reason for the swelling which is not desired as it may hinder the even descent into the melting zone and changes the consumption of carbon.

EXAMPLE 7.1

The lower momentary maximum pressure of 1000 kg per sq/ cm was applied in this example. It was the only change in regard to Example 7. The obtained moist cylinder was heat-treated in simulation of the traveling grate up to 700° C. The resulting hard self-reducing coke composite was left in the silica tube for the simulation of the descent in the submerged arc furnace. As in Example 7, it was heated in the reducing atmosphere up to 1000° C. in about 40 minutes to provide not only the sensible heat but more importantly, the endothermic reduction heat. Then the heating was terminated and cooling was undertaken until the now metallized cylinder had a temperature lower than about 100° C. The cylinder had shrunk considerably and uniformly to a cylinder which was completely metallized due to quasi-solid-stage reactions. The cylindrical shape confirms that the higher pressure of 1300 kg per sq. cm in Example 7 was responsible for the swelling of a part of the cylinder.

EXAMPLE 7.2

HIGHER HEATING IN SIMULATION OF THE SUBMERGED ARC FURNACE

In practice, higher heating means a deeper descent of the burden into the submerged arc furnace. In this simulation the self-reducing coke composite identical with that of Example 7.1 was heated in the reducing atmosphere of the silica tube up to 1200° C. in about 45 minutes. Then the cylinder was cooled to below 100° C. and taken out of the silica tube. It had shrunk uniformly and showed signs of the beginning of fusion as metallic beads had oozed out to the surface. When such bodies are heated further in the submerged arc furnace the fluidity of the slag increases so that globules of iron and slag drop into the molten slag covering the iron pool which is heated to the tapping temperature by the electric resistance of the slag between the feet of the arcs. The new material is quickly mixed and heated to the high temperature so that the equilibrium between slag and iron is approached rapidly. Therefore, the concentration of Si is low. Iron and slag are tapped and separated in a known manner. The iron being free of tramp elements can be used for the production of a high-grade steel.

On the credit side in favor of the present process stands the heating value of the unused portion of the condensed volatile matter and of the cleaned off-gas from the traveling grate and of the top gas from the submerged arc furnace which contains the carbon monoxide developed by the reduction of FeO and the residual hydrogen from the coke composites.

Another important advantage of the present process is than the solid state reduction prevents the formation of a slag rich in FeO which corrodes the lining of the furnace as happens in the prior art of feeding pieces of iron ore or pellets and pieces of the reductants and of the slag-forming additives into the submerged arc furnace.

Still another advantage is that making the composites of coke and FeO does not require electric power for heating. The even consumption of power in the arc furnace improves the power factor. For all these reasons it was estimated that the power consumption per 1000 kg of liquid iron is about 1400 Kwh.

EXAMPLE 8

MAKING HARD SELF-REDUCING COKE-FeO, MnO COMPOSITES FOR SMELTING TO STANDARD FERROMANGANESE IN A SUBMERGED ARC FURNACE

The desired composition of the standard ferromanganese is: 75% Mn. 19% Fe, less than 2% Si and 7% C. The source of manganese is preferably a soft ore which is usually available at a discounted price. Such an ore was selected for this example. It contained 44.55% Mn., 12.02% available oxygen, 3.31% Fe, 5.38% $SiO_2$, 15% $Al_2O_3$. The starting materials for 1000 kg of standard ferromanganese must contain 750+3% losses=773 kg of Mn contained in 1773 kg of said ore. This amount introduces also 54 kg of Fe so that 190−54=136 Kg of additional Fe must be provided in the form of an iron ore. If the selected ore contains 57% Fe than 230 kg of this ore are required. Another starting material is 336 kg of fine limestone.

The required amount of coal can be calculated as follows: The 750 kg of Mn require 164 kg of C for the reduction of MnO. The 190 kg of Fe require 40.8 kg of C for the reduction of FeO. The 20 kg of Si require 17.1 kg of C for the reduction of $SiO_2$. The carburisation of the liquid alloy requires 70 kg of C. Altogether 281.9 kg of C are needed. This amount is introduced by 485 kg of a subbituminous coal with 57% effective carbon. In summary the starting materials for 1000 kg of liquid standard ferromanganese are: 1773 kg Mn-ore with 44.55% Mn and 3.31% Fe in particles smaller than 0.4 mm, 239 kg of an iron ore with 57% Fe in particles smaller than 0.4 mm, 336 kg limestone with 95% $CaCO_3$ in particles smaller than 0.4 mm, and 495 kg of a subbituminous coal with 57% effective C in particles smaller than 0.2 mm. The power consumption per 1000 kg of liquid standard ferromanganese was estimated to amount to 1430 kwh.

The strength of the self-reducing coke composite was determined as before by mixing 1/250000 fractions of the starting materials listed above, mixing the mixture with sufficient water, densifying the moist mixture to aggregates, compressing the aggregates under a momentary maximum pressure of 1400 kg per sq. cm. The resulting moist cylinder was placed into the silica tube for the simulation of the heat-treatment on the traveling grate. The heating rate was the same as in Example 7 up to 700° C. Then the cylinder was cooled in the reducing atmosphere to less than about 100° C. and taken out of the silica tube. The obtained self-reducing coke composite had shrunk well and was hard. Therefore in practice such composites will be well suitable to be fed into a submerged arc furnace.

For the simulation of such smelting, the above self-reducing composite was put back into the reducing atmosphere of the silica tube and heated to about 750° C. in 5 minutes and further to about 1100° C. in 40 minutes. After cooling to less than 100° C. the reduced composite was taken out of the tube. The cylinder had shrunk considerably and evenly in all three dimensions. In other words such composites are heat stable and shrink up to the fusion, although the maximum momentary pressure for compacting the moist cylinder had been 1300 kg per sq. cm.

EXAMPLE 9

HARD SELF-REDUCING COKE COMPOSITES FOR SMELTING TO Fe-Cr BASE METAL FOR STAINLESS STEEL IN A SUBMERGED ARC FURNACE

The objective of this mode of the present process is making liquid ferro-chrome to be the base metal for 18-8 stainless steel. The base metal for said 18-8 steel contains about 20% Cr, 75% Fe, less than 2% Si and 3% C. The required starting materials are calculated in the following for the production of 1000 kg of liquid base metal. Therefore 206 kg of Cr are required if a loss of 3% of the Cr is assumed later. As source of Cr, fine Transvaal chromite ore was selected. It contained 26% Cr and 28% Fe. The above 206 kg of Cr require then 792 kg of Transvaal ore in particles smaller than about 0.3 mm, which amount also contains 28% Fe=222 kg Fe. As 772 kg Fe are required, the missing 550 kg of Fe must be provided by an iron ore. A concentrate with 65.1% Fe was selected so that 850 kg of said ore in particles smaller than about 0.3 mm are needed. For forming the slag 200 kg of limestone with 95% $CaCO_3$ in particles smaller than 0.4 mm are required.

The amount of the starting subbituminous coal is precalculated from the composition of the 1000 kg of the base metal. These 1000 kg contain 206 kg of Cr. Its reduction from $Cr_2O_3$ requires 70 kg of C. The 750 kg of Fe require 161 kg of C for the reduction of FeO to Fe. The reduction of $SiO_2$ to 20 kg of Si requires 17 kg of C. The carburisation of the liquid base metal requires 30 kg of C. Altogether 278 kg of C are necessary in the self-reducing coke composites when they are smelted to the base metal. These 278 kg of C originate from 488 kg of a subbituminous coal containing 57% effective carbon when used as starting material.

In summary the starting materials are: 792 kg of Transvaal chromite ore with 26% Cr and 28% Fe, 850 kg of said iron ore with 64.1% Fe and 200 kg of said limestone.

For simulating the heat-treatment on the traveling grate 1/250,000 fractions of the above starting materials were mixed dry and then mixed with sufficient water, densified to aggregates which were compressed to a moist cylinder under a momentary maximum pressure of 1400 kg per sq. cm. The moist cylinder was dried and carbonized and finally cooled in simulation of the traveling grate as in Example 7. the resulting cooled self-reducing coke composite was hard and well suitable on a commercial scale to serve as feed for the submerged arc furnace. The power consumption per 1000 kg of liquid base metal for 18-8 stainless steel was estimated to amount to 1600 kwh.

The resulting liquid base metal is charged into an oxygen converter. To the charge are added: the proper amount of nickel-bearing material, pieces of compatible stainless steel scrap and granular limestone. Then the oxygen blow is started to remove the carbon in a known manner.

HARD SELF-REDUCING COKE $SiO_2$ COMPOSITES FOR SMELTING TO SILICON IN A SUBMERGED ARC FURNACE

BACKGROUND

In the prior art of making silicon in a submerged arc furnace, pieces of quartzite and pieces of the carbonaceous reductants low in ash are changed into the furnace. The latter are carbonized to coke while volatile matter is expelled. For smelting to silicon, the coke pieces floating in the liquid $SiO_2$ react with the liquid. The melting point of $SiO_2$ is 1413° C. As the liquid $SiO_2$ provides the heat for the endothermic reduction of $SiO_2$, it must be overheated to 1800° C. and higher. At these temperatures the vapor pressure of Si, SiO and SiOC are considerable and a part of them escapes with the top gases of the furnace. The recovery of Si ranges from 72 to 78%. The top gases of the furnace, consisting mainly of the CO formed by the reduction are contaminated by volatile matter from the coal, by fumes and re-oxidized Si-compound, so that it is not profitable to utilize the high heating value. The power consumption for 1000 kg of silicon is reported to be 13,000 kwh. All these drawbacks are overcome by the present process.

EXAMPLE 10

BRIEF DESCRIPTION OF THE PRESENT PROCESS

The present process is characterized by the use of hard self-reducing composites of coke+$SiO_2$. The calculation of the starting materials for such composites is based on the equation $SiO_2+2\ C=Si+2\ CO$ and refers to 1000 kg of silicon. As the selected quartzite contained 98% $SiO_2$ and a loss of 3% of the $SiO_2$ is assumed, 1000 kg of Si require 2261 kg of quartzite as starting material in particles smaller than 0.4 mm. The self-reducing composites contain 857 kg of C for the reduction. This amount comes from a high volatile subbituminous coal low in ash and containing 65% effective C. Therefore, 1318 kg of this coal in particles smaller than 0.2 mm are the other starting material.

On the commercial scale both starting materials are mixed in the above proportion. The mixture is moistened and densified to aggregates as described before. The aggregates are compressed to moist compacts by a momentary maximum pressure of 1400 kg per sq. cm as achieved by smooth double rolls forming a continuous ribbon about 5 cm thick and which is divided into single bodies which are heat-treated and cooled on the traveling grate and divided into pieces as described before. The resulting hard self-reducing pieces of the composites are the feed for the submerged arc furnace.

In order to show the shrinking and the strength of the pieces of the coke composites, the already described simulation of the heat-treatment on the traveling grate was applied. Accordingly 1/500,000 fractions of the starting materials were mixed. That is, 4.5 g of said quartzite particles were mixed with 2.64 g of said coal particles. The mixture was moistened, densified and compressed under a momentary maximum pressure of 1100 kg per sq. cm to a moist cylinder weighing 7.92 g and being 38.2 mm long. After the simulated heat-treatment as on the traveling grate, the coke composite weighed 5.93 g and was 32.1 mm long and was hard.

That means, the pieces of self-reducing coke composites obtained by dividing the cooled discharge from the traveling grate are well suited to be fed into the submerged arc furnace. If this is done on the industrial scale, the pieces are quickly heated to between 800° and 900° C. Then the heat consuming solid state reactions begin and end with the formation of Si before its melting point of 1413° C. is reached. When the melting point is exceeded for tapping the silicon, its vapor pressure is still insignificant. Nevertheless a loss of 3% of the silicon was assumed above. The power consumption for 1000 kg of silicon was estimated to amount to 7,150 kwh compared with 13,000 kwh in the prior art.

On the credit side in favor of the present process can be listed the potential utilization of the heating values of the unused part of the condensed volatile matter and of the off-gas from the traveling grate and more importantly of the rather clean top-gas from the submerged arc furnace.

PART 3

SMELTING HARD, SELF-REDUCING COKE-OXIDE COMPOSITES IN A LOW-SHAFT BLAST FURNACE TO IRON, FERRO-ALLOYS OR SILICON

The principal feature in this modification is to replace the electrical energy consumed in the submerged arc furnace by the thermal equivalent which theoretically is 1 kwh=860 kcal. In this connection it may be noted that hydrogen in the fuel for the shaft furnace has no heating value as $H_2O$ cannot be formed at high temperatures in the presence of C and CO, Hydrogen leaves the shaft furnace together with the top-gas for subsequent utilization of the heating value.

The highest heat value is obtained when carbon is combusted to $CO_2$. However, flame gases with a high ratio of the partial pressures of $CO_2$/ CO oxidize. While such combustion gases pass the burden in the shaft furnace, they have no metallurgical effect on the burden because $CO_2$ cannot diffuse into the dense pieces due to its molecular size and because CO is diffusing outwards. But in the tuyere zone the conditions are different. There, metallic pearls held together by a pasty slag are briefly exposed to $CO_2$ while they drop into the liquid slag covering the metal pool so that a small amount of the metal is oxidized but quickly reduced again by the carbon dissolved in the metal. In other words, the oxidation leads to the loss of a small amount of carbon in the form of CO. Laboratory experiments in which self-reducing coke composites of Example 7.1 were heated by radiation under a blanket of a gas mixture of 80 vol. % nitrogen, 12 vol. % $CO_2$ and 8 vol. % CO, that is a vol. ratio of 60 $CO_2$/40 CO up to about 1400° C. in about 15 minutes. It was found that 3.4% of the carbon incorporated in the self-reducing compacts for the reduction were lost. However, the experimental conditions were different from the conditions in the tuyere zone. Therefore the loss of 3.4% is not accurate. It can be determined accurately only during the operation of the shaft furnace.

It is a feature of the present process that the lost carbon is made up by mixing the corresponding amount of coal particles smaller than 0.2 mm with those applied as starting material for the submerged arc furnace.

In another modification the carbon lost in the tuyere zone is made up by introducing the necessary amount of carbon in the form of fine grains of carbonaceous materials such as coals or coke into the tuyere zone. It is understood that both methods of making up the lost carbon may be combined.

Specific data are reported in connection with the following examples.

MAKING HARD SELF-REDUCING COKE-FeO COMPOSITES AND SMELTING THEM IN A FUEL FIRED LOW SHAFT BLAST FURNACE TO IRON

EXAMPLE 11

This example relates to Example 7.1 in which the starting materials for 1000 kg of iron were: 1746 kg of fine particles of an iron ore containing 57% Fe, 433 kg of fine particles of a subbituminous coal containing 58% effective carbon and 250 kg of fine limestone. The power consumption was estimated to amount to 1430 kwh. The thermal equivalent of 1 kwh=860 kcal is in this case 1,229,800 kcal. For the partial combustion of carbon the volume ratio of 60 $CO_2$/40 CO was selected. As 600 g of carbon generate 4783 kcal if combusted to $CO_2$ and 400 g of carbon generate 880 kcal if combusted to CO, 1 kg of carbon generates 5663 kcal if combusted in this ratio. Therefore the above 1.0 million kcal require 176.6 kg of carbon in the form of coal dust containing 55% fixed carbon and 82% of total carbon weighing 259 kg. To the cost of the coal dust the above named 3.4% of 433 kg=16 kg of fine particles of subbituminous coal replacing the lost carbon must be added so that the 1430 kwh are replaced by 259 kg of coal dust from a subbituminous coal and by 15 kg of fine particles of the same coal.

In regard to the combustion air, it is understood that preheated or oxygen-enriched air may be used.

MAKING HARD SELF-REDUCING COKE-MnO, FeO COMPOSITES FOR SMELTING TO STANDARD FERRO-MANGANESE IN A LOW SHAFT BLAST FURNACE

EXAMPLE 12

This example is related to Example 8 in which the starting materials for 1000 kg of standard ferromanganese were 1773 kg of a soft Mn-ore with 44.55% Mn and 3.31% Fe, 235 kg of an iron ore with 57% Fe, 485 kg of a subbituminous coal with 57% effective carbon and 336 kg of fine limestone; 1430 kwh were needed. The thermal equivalent is 1,229,800 kcal. As 1 kg of carbon generates 5663 kcal if it is combusted to $CO_2$/CO in the volume ratio of 60/40, then 217 kg of carbon in the form of 236 kg of coal dust from a subbituminous coal with 55% of fixed carbon and 82% total carbon was approximately needed. Assuming a loss of 4.5% in the melting zone, 22 kg of the subbituminous coal with 55% fixed carbon and in particles smaller than 0.2 mm must be mixed with the 485 kg of said subbituminous coal and with the other starting materials for this example.

Therefore, 1430 kwh are replaced by 236 kg of coal dust and by 22 kg of coal particles smaller than 0.2 mm from the same subbituminous coal.

The procedure of making the coke composites for smelting to standard ferro-manganese in this Example 12 is the same as in Example 8. In the industrial practice the obtained pieces of self-reducing coke composites having a temperature of about 200° C. are fed into the low shaft furnace in which they descend in a countermove to ascending combustion gases coming from the tuyere zone and being mixed with carbon monoxide developed in the composites due to the reduction as in Example 11.

In simulating tests with one self-reducing coke composite, the heating was terminated at 1100° C. whereupon the cylinder was cooled to less than 200° C. and taken out into the open air for examination. The original cylinder had shrunken uniformly and considerably to a very hard metallic body. The reduction of MnO was nearly complete. When in practice the temperature rises higher than 1100° C., the fusion of the slag phase begins at about 1200° C. and at about 1250° C. globules of metal and slag begin to drop through the tuyere zone into the overheated slag. Hereby the excess of carbon is oxidized by $CO_2$. As the slag receives the globules with the completely reduced metals at an even rate, the desired content of 75% Mn and the slag low in MnO are obtained steadily in the process.

MAKING HARD SELF-REDUCING COKE COMPOSITES FOR SMELTING TO BASE METAL OF STAINLESS STEEL IN A LOW SHAFT BLAST FURNACE

EXAMPLE 13

This example is related to Example 9 in which the starting materials for 1000 kg of base metal for 18-8 stainless steel were: 792 kg of fine Transvaal chromite ore with 26% Cr and 28% Fe, 850 kg of iron ore with 64.1% Fe, 488 kg of a subbituminous coal with 57% carbon and 200 kg of fine limestone. The power consumption was estimated to amount to 1400 kwh.

In this Example 13, said electric power is replaced by the thermal equivalent of 1,204,000 kcal. Furthermore, in this example the higher ratio of 70 $CO_2$/30 CO is applied so that 700 g of carbon generate 5483 kcal if combusted to $CO_2$ and 300 g of carbon generate 660 kcal if combusted to CO. Therefore 1 kg of carbon generates 6143 kcal and the above 1,204,000 kcal require 196 kg of carbon which is applied in the form of coal dust from the same subbituminous coal as used for the reduction which contains 57% fixed carbon and 82% total carbon so that 239 kg of coal dust must be partially combusted.

It was estimated that these flamegases oxidize 4.5% of the 488 kg of the starting coal in Example 9, that is 22 kg of the same fine particles must be mixed with said 488 kg in order to make up for the loss of carbon in the tuyere zone. In conclusion the 1400 kwh in Example 9 are replaced by 239 kg of coal dust of the subbituminous coal containing 82% total carbon and by 22 kg of the same coal but in particles smaller than about 0.2 mm.

The liquid base metal and the slag are tapped from the blast furnace. The metal is separated from the slag and converted in an oxygen converter to 18-8 stainless steel as described in Example 9.

PART 4

MAKING STEEL DIRECTLY FROM HARD SELF-REDUCING COMPOSITES OF COKE-FeO IN THE OPEN HEARTH

EXAMPLE 14

In this process pieces of the hard composites of coke-FeO as made according to example 7.1 are charged into the open hearth still being hot from a previous operation and having one hot set of checkers. Fuel oil is injected into the hot air flowing from the hot checkers. When the top layer of the charge is heated to higher than 800° C., the quasi solid-stage reduction of FeO begins and the developed CO emerges from the charge and is combusted to $CO_2$ in the hot air. While the combustion heat from $CO_2$ increases, the rate of fuel oil injection is decreased until the injection is stopped. When the upper part of the charge is heated to about 1100° C., the quasi solid-state reduction is finished but the CO development continues in parts of the charge having a lower temperature. The upper part being completely metallized is heated further to about 1250° C., whereby the pieces lose their shape, and at further increasing temperatures, molten iron and slag trickle down through the charge and form an iron pool covered by slag. The melting exposes the next layer directly to the radiation from the roof and causes quick melting of the pieces already heated by secondary radiation. These events continue until insufficient CO is combusted to $CO_2$ because the FeO is already reduced. Then granular limestone is charged into the hearth is the slag is not basic enough. Furthermore pieces of iron or steel scrap free of harmful contaminations such as tramp elements are charged. However, such scrap is costly and available only in limited quantities. Therefore it is preferred to charge as coolant, pieces of self-reducing composites of coke and FeO as used at the start of the operation.

Then oxygen is injected into the iron pool whereby the oxidation of C to CO generates heat and the subsequent combustion of CO to $CO_2$ generates more heat so that the charge, and the added coolant are melted and heated through the refining period up to the tapping temperature.

The oxygen injection is continued until the specified content of carbon is reached as it has been done in oxygen converters.

In conclusion, the above process has the potential to make a high grade steel directly.

MAKING STAINLESS STEEL FROM COMPOSITES OF COKE—Fe, Cr OXIDES IN AN OPEN HEARTH

EXAMPLE 15

This example is related to example 9 in which hard pieces of self-reducing composites of coke—Fe, Cr oxides were smelted in a submerged arc furnace to ferro-chrome called base metal, for the subsequent conversion to 18-8 stainless steel in an oxygen converter.

In this example 15 the same hard pieces of self-reducing composites of coke—Fe, Cr oxides as coming from the traveling grate are charged into an open hearth and heated therein as in example 14 by a flame of fuel oil and by the combustion of CO to $CO_2$, whereby a metal pool covered by slag is formed on the bottom of the hearth. When the quasi solid state reduction does not supply sufficient CO anymore, then the proper amount of nickel-bearing particles and pieces of compatible stainless steel scrap and, if necessary, granular limestone are charged into the hearth, whereupon oxygen is injected into the metal pool. It oxidizes C to CO, generating heat, and emerges to above the charge and is combusted to $CO_2$ generating more heat so that the residual solid-reduced bodies, the nickel-bearing particles, the scrap of stainless steel are melted and the limestone grains are dissociated and the CaO is dissolved in the slag. Furthermore, the whole content of the hearth is heated to the tapping temperature of the 18-8 stainless steel.

The injection rate of oxygen is gradually decreased when the complete removal of carbon is approached and finally terminated. In order to decrease the loss of $Cr_2O_3$ in the slag, the known method of diluting the oxygen with argon may be used. It may be noted that refining occurs during the oxygen injection.

The above measures can be applied for making other grades of stainless steel.

Recapitulation of the Invention and of the Significance of the Examples

Coke of high density and strength is made continuously from a bituminous or subbituminous or lignite coals or of mixtures thereof by dividing the selected coal or coals into particles smaller than nominal about 0.2 mm, treating the divided particles with air at temperatures below about 220° C. to such an extent that the oxygenation of the coal particles leads to shrunken coke of high density and strength at the end of this process.

The coal particles, oxygenated to the predetermined optimal extent, are mixed with sufficient water and the mixture is mulled to aggregates which are compressed by smooth double rolls under a momentary maximum pressure of about 1300 kg per sq cm to a ribbon about 5 cm thick whereby a small part of the admixed water is squeezed out. The ribbon is divided into single bodies which are placed onto a traveling grate where they form a bed at least 30 cm deep. The grate carries the bed through the drying chamber in about 10 minutes and then through the pyrolyzing section and carbonizing section in at least about 50 minutes in which time the shrunken bodies have reached temperatures between 700° and 750° C. Then the grate carries the hot shrunken bed through the cooling chamber in which a sufficient volume of a reducing gas flows through the bed and then to a heat-exchanger and back to the cooling chamber. When the bed is colder than about 200° C., the grate carries it to the discharge into a breaker which divides the discharge into the desired sizes of pieces of high density and strength.

A modification comprises mixing particles smaller than about 0.4 mm of a carbonaceous material low in volatile matter, such as coke fines or char or anthracite coal, with the coal particles smaller than about 0.2 mm in any desired proportion up to a weight ratio of about 60 to 40 and decreasing the extent of the oxygenation to near zero, or to zero.

Another modification comprises mixing the coal particles smaller than about 0.2 mm with limestone particles smaller than 0.4 mm and weighing so much that the contained $CaCO_3$ exceeds by about 10% stoichiometrically the sulfur content in the final coke of high density and strength. The mixture of the coal and the limestone particles is oxygenated to a lesser extent than the coal particles alone and is mixed with water and converted to high density coke. When such coke is burnt, the sulfur is trapped in the form of $CaSO_4$ which is intermingled with the ash.

A further modification comprises mixing coal particles smaller than about 0.2 mm without any oxygenation with particles smaller than about 0.4 mm of carbon-reducible oxide materials such as the oxidic ores of Fe, Mn, Cr and quartzite, and with particles smaller than about 0.4 mm of slag-forming additives if necessary, in the proportion of the oxides than after making self-reducing composites and smelting them in a submerged arc furnace, liquid iron, ferroalloys and silicon respectively are formed.

The proportion of the coal particles to the oxide particles is such that the compaction to bodies and their heat-treatment on the traveling grate result in self-reducing coke composites of coke-oxides which produce the desired iron, ferroalloy or silicon by smelting in a submerged arc furnace.

It is to be noted that the reduction of the oxides happens in quasi solid-state reactions before any fusion occurs.

This reduction technology prevents the fluctuation of the composition of the tapped products, improves the recovery of the end product, saves electric power and generates rather clean top gases of the arc furnace.

A modification of the smelting procedure comprises replacing the electric energy by the equivalent thermal energy generated by the partial combustion of coal dust and/or of a fluid fuel to at least a volume ratio of 60 $CO_2$/40 CO in a low shaft blast furnace into which the self-reducing composites of coke+carbon-reducible oxides have been fed. As the high partial pressure of $CO_2$ oxidizes a small part of the carbon in the tuyere zone, the loss is replaced at the start of the process by mixing the corresponding amount of coal particles smaller than 0.2 mm with the starting amount of this coal, and/or replacing the lost carbon by introducing fine grains of carbonaceous matter into the tuyere zone. It is understood that the combustion air may be preheated and/or oxygen-enriched. The tapped iron and ferroalloys may be treated in the ladle. The iron may be decarburized to a high grade steel without any tramp elements. Tapped ferrochrome may be decarburised while nickel is added to stainless steel.

A third method of smelting composites of coke +FeO or of composites of coke+FeO, $Cr_2O_3$ directly to steel or stainless steel involves the use of an open hearth furnace. In the case of making steel, self-reducing composites of coke+FeO, as made for smelting in the arc furnace, are charged into an open hearth furnace and heated therein by injecting fuel oil into the hot air coming from the checkers until the quasi solid state reduction develops sufficient CO which combusts to $CO_2$ in the hot air. This heat melts the reduced bodies to iron and slag which collect on the bottom of the hearth. When the development of CO dies down, granular limestone and, if necessary, some more cooling agent such as iron and steel scrap free of harmful contaminants or self-reducing composites of coke+FeO are charged into the open hearth as charged in the beginning. Then oxygen is injected into the iron pool to oxidize carbon to CO, generating heat. The CO emerges from the charge and is combusted in the hot air generating more heat so that the entire content of the hearth is melted and the temperature is increased to the tapping level. The rate of the oxygen injection is gradually decreased when the specified content of carbon is approached and the injection is terminated when the specified content is reached as it has been done in the usual practice including the discharge of the hearth.

Making stainless steel directly comprises preparing self-reducing composites of coke+FeO, $Cr_2O_3$ which would result in the base metal of 18-8 stainless steel if smelted in a submerged arc furnace. However, in this process such composites are charged into the open hearth furnace in which the charge is heated as the composites for making carbon-steel. In the present process, a pool of ferrochrome collects on the bottom of the hearth.

When the development of CO by the reduction dies down, the hearth is charged with the proper amount of nickel-bearing material, compatible stainless steel scrap, granular limestone and self-reducing composites as charged at the start if other cooling materials are not available. The oxygen is injected into the pool of ferrochrome to oxidize C to CO, generating heat. CO emerges from the charge and is combusted in the hot air to $CO_2$, generating heat. The total heat melts the entire content of the hearth and brings it to the discharge temperature of the stainless steel and slag. The rate of the oxygen injection is diminished when a low carbon content is reached and completely terminated when the carbon is completely removed. As it had been done in the early practice of making stainless steel, particles of ferro-silicon are charged onto the slag in order to reduce chrome oxide back into the metal.

Alternatively, the metal pool may be partly decarburized in the open hearth and the content of the hearth then transferred to an oxygen converter for the finish by one of the recent methods.

It will be appreciated that the foregoing specification and Examples thereof are set forth by way of illustration and not limitation, and that various modifications and changes may be made therein without departing from the spirit and scope of the present invention.

What is claimed is:

1. A process of continuously making pieces of coke of high density and strength which process includes as an essential part of same the heat processing of compacted carbonaceous bodies on a traveling grate through a compartmentalized heating apparatus comprising a drying chamber, a carbonizing chamber consisting of a first pyrolyzing section and a second carbonizing section, and a cooling chamber, comprising the following steps:

a. selecting at least one coal from bituminous or subbituminous or lignite coals in which the contents of ash and sulfur of coke made therefrom would be suitable for use in a blast furnace;

b. dividing the selected material into particles smaller than nominal about 0.2 mm;

c. oxygenating the particles with oxygen by the treatment with air at below 220° C. for such a period of time that the extent of oxygenation obtained at least assists toward obtaining a final product of this process as shrunken coke pieces of high density and strength;

d. mixing the thus oxygenated coal particles with such amount of water that the later compression step f of this claim squeezes out a small part of the added water;

e. aggregating the moist mixture by repeated pressing and stirring;

f. compressing the aggregates by means of smooth double rolls under a momentary maximum pressure in the range from about 800 to 1600 kg per sq. cm. whereby a small part of the added water from step d. is squeezed out and a continuous ribbon of about 5 cm thickness is formed;

g. dividing the ribbon into single compacted bodies;

h. placing the bodies on a traveling grate to form a bed at least 30 cm deep;

i. moving the grate with the bed on it through the drying chamber of the heating apparatus during about 10 minutes and heating the bed to not higher than 220° C. when it leaves the drying chamber;

j. conducting the exhaust gases from step i. laden with steam to a stack or heat exchanger;

k. moving the grate with the dehydrated bed into and through the first pyrolyzing section of the carbonizing chamber of the heating apparatus in which the bed is heated during at least 25 minutes to about 500° C. by gases coming from the carbonizing section of the carbonizing chamber of the heating apparatus and flowing upwards through the bed;

l. conducting the exhaust gases from step k. laden with volatile matter to equipment for washing and cooling to remove hydrogen sulfide and to separate the condensed volatile matter from the exhaust gases devoid of the hydrogen sulfide;

m. moving the grate and bed which is shrinking into and through the carbonizing section of the heating apparatus during at least 25 minutes in which the bodies continue to shrink by heating them from about 500° C. to at least between 700° and 750° C.;

n. introducing at the end of the second carbonizing section of the carbonizing chamber above the bed the hot gases of the complete combustion of a fluid fuel which flow down through the bed and heat it to the above maximum temperature and are conducted to the pyrolyzing section;

o. moving the grate and bed into and through the cooling chamber of the heating apparatus filled with a reducing gas which flows down and up through the bed, then to a heat exchanger and back to the cooling chamber;

p. moving the grate and bed when the latter has a temperature lower than about 200° C. out of the cooling chamber into the open air to discharge the bed from the grate; and q. discharging the coke bed into a breaker for dividing the coke of high density and strength into pieces of the desired size.

2. A process according to claim 1 in which the extent of oxygenation carried out in step c. is progressively decreased to near zero by mixing the divided coal particles from step b with increasing amounts of particles smaller than 0.4 mm of carbonaceous material low in volatile matter, such as coke fines, coke breeze, char or anthracite coal.

3. A process according to claim 1 in which the treatment of the divided coal particles with air in step c. is lessened and the balance of the oxygenation is carried out by drying the compacted bodies from step g. in the drying chamber of the heating apparatus by a mixture of combustion gases and air for such a period of time that the optimal extent of the oxygenation is obtained.

4. A process according to claim 1 wherein in step i. the drying chamber consists of two sections and the grate and bed pass under an apron of flexible material which hangs from the ceiling of the drying chamber so that the loose lower edge of the apron slides over the bed when the latter moves through the first section during about 7 minutes during which time it is dried and then the grate and bed pass under a second apron into the second section and through which the bed on the grate travels during about 3 minutes and leaves the section at a temperature not higher than about 220° C.

5. A process according to claim 4 wherein the drying chamber is heated by the hot gases of the complete combustion of a fluid fuel introduced into the second section and drawn downwards through the bed and then blown upwards through the bed in the first section.

6. A process according to claim 1 wherein in step k the grate and bed pass under an apron which separates the pyrolysis section from the drying chamber and in which pyrolysis section the bodies are heated by gases being blown upward through the bed coming from the carbonizing section.

7. A process according to claim 1 wherein in step m the grate and be pass under an apron which separates the pyrolysis section from the carbonizing section of the carbonizing chamber and during which heating step the shrinking of the bodies continues and the bodies are converted to coke of high density and strength.

8. A process according to claim 1 wherein in step o the cooling chamber consists of two sections separated by an apron and the grate and the coke pass under an apron separating the carbonizing chamber from the cooling chamber and cooled reducing gas is blown downward through the coke in the second section and upwards through the hot coke in the first section, whereupon the hot reducing gas is sent to the heat exchanger to utilize its sensible heat.

9. A process according to claim 1 in which particles of limestone smaller than about 0.4 mm are mixed with the divided coal particles from step b. in such a proportion that the contained CaCO exceeds by about 10% stoichiometrically the content of sulfur in the final product of coke pieces of high density and strength, which burn with insignificant pollution and leave the ash intermingled with calcium sulfate.

10. A process of continuously making pieces of coke of high density and strength which process includes as an essential part of same the heat processing of compacted carbonaceous bodies on a traveling grate through a compartmentalized heating apparatus comprising a drying chamber, a carbonizing chamber consisting of a first pyrolyzing section and a second carbonizing section, and a cooling chamber comprising the following steps:

a. selecting at least one coal from bituminous, subbituminous or lignite coals in which the contents of ash and sulfur of coke made therefrom would be suitable for use in a blast furnace;

b. dividing the selected material into particles smaller than nominal about 0.2 mm;

c. mixing the divided coal particles from step b. with particles smaller than about 0.4 mm of a carbonaceous material low in volatile matter such as coke fines, coke breeze, char or anthracite coal;

d. moving the carbonaceous particles from step c. with such an amount of water that the later compression step f of this claim squeezes out a small part of the added water;

e. aggregating the moist mixture by repeated pressing and stirring;

f. compressing the aggregates by means of smooth double rolls under a momentary maximum pressure in the range from about 800 to 1600 kg per sq. cm whereby a small part of the added water from step d. is squeezed out and a continuous ribbon of about 5 cm thickness is formed;

g. dividing the ribbon into single compacted bodies;

h. placing the bodies on a traveling grate to form a bed at least 30 cm deep;

i. moving the grate with the bed on it through the drying chamber of the heating apparatus during about 10 minutes and heating the bed to not higher than 220° C. when it leaves the drying chamber;

j. conducting the exhaust gases from step i. laden with steam to a stack or a heat exchanger;

k. moving the grate with the dehydrated bed into and through the first pyrolyzing section of the carbonizing chamber of the heating apparatus in which the bed is heated during at least 25 minutes to about 500° C. by gases coming from the carbonizing section of the carbonizing chamber of the heating apparatus and flowing upwards through the bed;

l. conducting the exhaust gases from step k. laden with volatile matter to equipment for washing and cooling to remove hydrogen sulfide and to separate the condensed volatile matter from the exhaust gases devoid of the hydrogen sulfide;

m. moving the grate and bed which is shrinking into and through the carbonizing section of the heating apparatus during at least 25 minutes in which the bodies continue to shrink by heating them from about 500° C. to at least between 700° and 750° C.;

n. introducing at the end of the second carbonizing section of the carbonizing chamber above the bed the hot gases of the complete combustion of a fluid fuel which flow down through the bed and heat it to the above maximum temperature and are conducted to the pyrolyzing section;

o. moving the grate and bed into and through the cooling chamber of the heating apparatus in a sufficient volume of a reducing gas to flow down and up through the bed, then to a heat exchanger and back to the cooling chamber;

p. moving the grate and bed when the latter has a temperature lower than about 200° C. out of the cooling chamber into the open air to discharge the bed from the grate; and q. discharging the coke bed into a breaker for dividing the coke of high density and strength into pieces of the desired size.

* * * * *